US006253531B1

(12) United States Patent
Steele

(10) Patent No.: US 6,253,531 B1
(45) Date of Patent: Jul. 3, 2001

(54) PACKAGING MACHINE

(76) Inventor: Richard L. Steele, 7975 Town Hall Rd., Sheridan, MI (US) 48884

( * ) Notice: Subject to any disclaimer, the term of this patent is extended or adjusted under 35 U.S.C. 154(b) by 0 days.

(21) Appl. No.: 09/332,079

(22) Filed: Jun. 14, 1999

(51) Int. Cl.[7] ..... B65B 51/10; B30B 5/00

(52) U.S. Cl. ..... 53/329.3; 53/510; 53/511; 100/244; 100/264

(58) Field of Search ..... 53/510, 511, 559, 53/329.3, 329.4, 329.5; 100/244, 264, 315, 324, 325, 272, 226; 156/69, 583.1

(56) References Cited

U.S. PATENT DOCUMENTS

| | | | | |
|---|---|---|---|---|
| 3,050,809 | * | 8/1962 | Kupka | 100/244 |
| 3,383,260 | * | 5/1968 | Mojonnier | 53/329.3 |
| 3,505,781 | * | 4/1970 | Loewenthal | 53/329.3 |
| 3,682,748 | * | 8/1972 | Kimball | 156/583.1 |
| 3,986,921 | * | 10/1976 | Ptnam, Jr. et al. | 100/264 |
| 4,133,260 | * | 1/1979 | Gundal | 100/272 |
| 4,148,933 | | 4/1979 | Janovtchik | 425/521 X |
| 4,317,697 | * | 3/1982 | McLean | 156/583.1 |
| 4,588,302 | * | 5/1986 | Pizzi et al. | 100/264 |
| 4,904,173 | | 2/1990 | Tanaka et al. | 425/149 |
| 5,176,923 | | 1/1993 | Ito | 425/150 |

* cited by examiner

*Primary Examiner*—Peter Vo
*Assistant Examiner*—Louis Huynh
(74) *Attorney, Agent, or Firm*—Breneman & Georges

(57) ABSTRACT

A platen machine for filling and sealing packages is provided having an upper platen and a lower platen journalled and independently moveable on a common alignment shaft to provide a close tolerance sealing mechanism with an independently operated heat seal element. The novel platen machine relocates clamping forces from the support frame to the alignment shaft so that the common alignment shafts bears the clamping forces and the carrier merely relies upon the frame to support the weight of the machine and not clamping forces. The upper platen moves toward the lower platen and the lower platen moves toward the upper platen to clamp a package between the two platens before an independently operated heat seal element is activated to advance to the clamped package and provide a heating and sealing cycle independent of the clamping cycle. Optional filling, gassing and evacuation can be provided during the clamping of the package without involving the separate heating and sealing operation.

24 Claims, 2 Drawing Sheets

PACKAGING MACHINE

BACKGROUND OF THE INVENTION

1. Field of Invention

The invention relates to a system for opening and closing a vacuum chamber for the purpose of thermoforming and/or evacuating, modifying atmosphere and sealing packages for both food and non-food stuffs, insuring that both upper and lower vacuum chambers are kept in alignment at all times.

2. Description of Related Art Including Information Disclosed Under 37 CFR 1.97 and 1.98

The prior art includes numerous machines and methods for filling and sealing packages employing heat sealing platens. These prior art methods and machines generally employ guide posts that are part of the frame of the machine so that closing forces on filled and sealed packages are a function to the overall machine rather than a function of the filling or sealing platens themselves. Further in such prior art the duration of the sealing forces and the heating of the heat seal are the same since sealing and heating are not separately controlled.

In the prior art clamping forces as high as 40,000 pounds are transmitted to and through the frame causing flexing, warping and fatigue in the frame which results in loss of tolerance in the clamping portion of the platen machine. Relevant prior art includes Janovtchik U.S. Pat. No. 4,148,933 and Ito U.S. Pat. No. 5,176,923. In Ito U.S. Pat. No. 5,176,923 (FIG. 1), a pair of guideposts 5, which are part of the machine frame raise or lower upper mold 2 or lower mold 3.

In contrast to such prior art the invention provides a filling and sealing machine that does not provide filling or sealing as a function of the overall machine but instead as a function of the platens themselves which are disposed on alignment shafts separate from the machine frame. The novel combination of platens, shaft and support provides a greater, more controlled and precise mating of top and bottom platens to assure closer tolerances that do not depend on the support frame of the machine to maintain those tolerances. Further in accordance with the invention the heating element is independently activated to provide control over the duration of the heat sealing portion of the operation. The sealing and filling tolerances achieved by the novel combination also provides greater control over forces since the forces are a function of the novel combination rather than of the entire machine.

Other prior art platen machines employ an upper platen, a lower platen and a moveable platen disposed between the upper and lower platen. Representative of this prior art includes Tanaka, et al. U.S. Pat. No. 4,904,173 for use in plastic molding arts which employs an upper platen 10, a lower platen 11 and a moveable platen 13 with a tie bar 12. In Tanaka, et al. U.S. Pat. No. 4,904,173 like the other prior art, the upper and lower platens are carried by the frame of the machine so that the closing forces and the precision of the machine is a function of the overall machine rather than as a function of the operation of the platens themselves. The invention in contrast provides for the precision of the closing forces operating as a function of the movement of the platens themselves by employing a common alignment shaft between the upper and lower platens. This arrangement on the common alignment shaft allows the upper and lower platens to move toward each other with great precision. A carrier plate assembly is mounted to a support frame, which frame merely provides support for the novel packaging machine without interfering with the filling and sealing operations of the novel packaging machine.

SUMMARY OF THE INVENTION

The present invention contemplates an apparatus for delivery, an upper and lower platen aligned by a common shaft. Vacuum chamber halves are attached to the platens by various means. The platens are moved pneumatically through a toggle arrangement to ensure a high closing force that will lock the two chamber halves together and insure a stable and leak free chamber.

The invention delivers and guides it's power through the common shafts and does not rely on the frame of the packaging machine for any power transmission; but, is held in the frame on wheels for adjusting to a given repeat length of the package.

When the invention is used in the sealing station, the upper chamber carries a heated sealing platen for the purpose of welding the two layers of packing materials together. The heat necessary for the welding process can be harmful to the package and/or it's ingredients if held in close proximity for a period of time. The invention provides that the upper chamber can be raised to approximately three inches above the package allowing air to pass between the heated platen and ingredients and protect it from the effects of the prolonged heat.

BRIEF DESCRIPTION OF THE DRAWINGS

FIG. #1 is a side view of the lifting apparatus showing the connections of the toggle systems in both the close and open positions.

FIG. #2 is a end view of the lifting apparatus showing that the frame of the packaging machine serves only to hold the lifting system in place. And shows the relationship of the packaging chambers in both the closed and open positions.

All items in both FIG. #1 and FIG. #2 have the same numbers; but ,some descriptions may be clearer in one or the other.

DETAILED DESCRIPTION OF THE BEST MODE OF THE INVENTION

Figure 1:
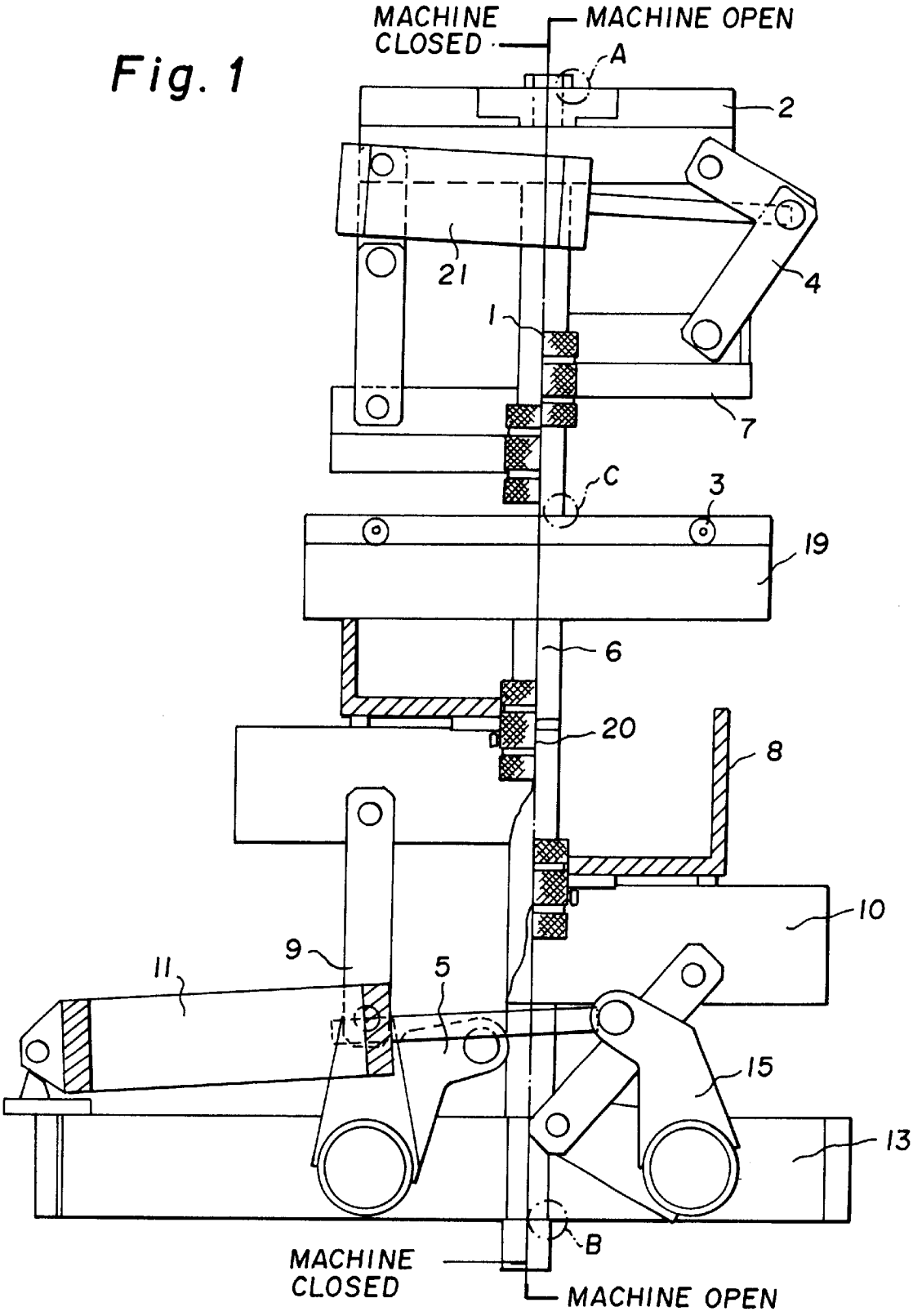

The main structure of the invention is comprised of three different parts, two (2) guide shafts [6], two (2) lower support bars [13] and one (1) upper support plate (2) as in FIG. #2.

The upper plate and the lower support bar clamp to the guide shafts at under cuts in the shaft. The under cuts provide a shoulder on the guide shaft to prevent linear movement of both the lower support bar [at point B] and the upper support plate [at point A].FIG. #1

The lifting assembly is supported in the frame of the packaging machine [12] on wheels [3] in the carrier plates assembly [19]. The carrier assembly is clamped to the guide shafts in under cuts at position [C]. The shoulder of the under cut prevent linear movement.

The main object of the lifting system is to raise and lower two platens, the lifting table [20] and the seal bridge [7], keeping them aligned.

The lower support bars carry two cross shafts 14 with lifting cranks [15]. FIG. #1

The lifting cranks are keyed to the shafts.. The shafts are held in time with each other by a tie rod between two lobs of the cranks [5], so as one shaft is turned so is the other. The main shaft is rotated by an air cylinder [11] attached to one crank assembly [15] and anchored to the end of the lower support bar [13].

Toggle arms [9] are attached between the lifting cranks and the lifting rails [10]. As the crank and shafts are rotated the toggle arms cause the lifting rails to move.

A lower platen or lifting table [20], with two larger linear bearings, is guided up and down the guide shafts [6].

The upper support plate [2] also carries a smaller toggle system operated by another air cylinder [21]. The toggle system is attached to the seal bridge [7]. The seal bridge has two large linear bearings 1 and is guided up and down the guide shafts [6].

Figure 2:
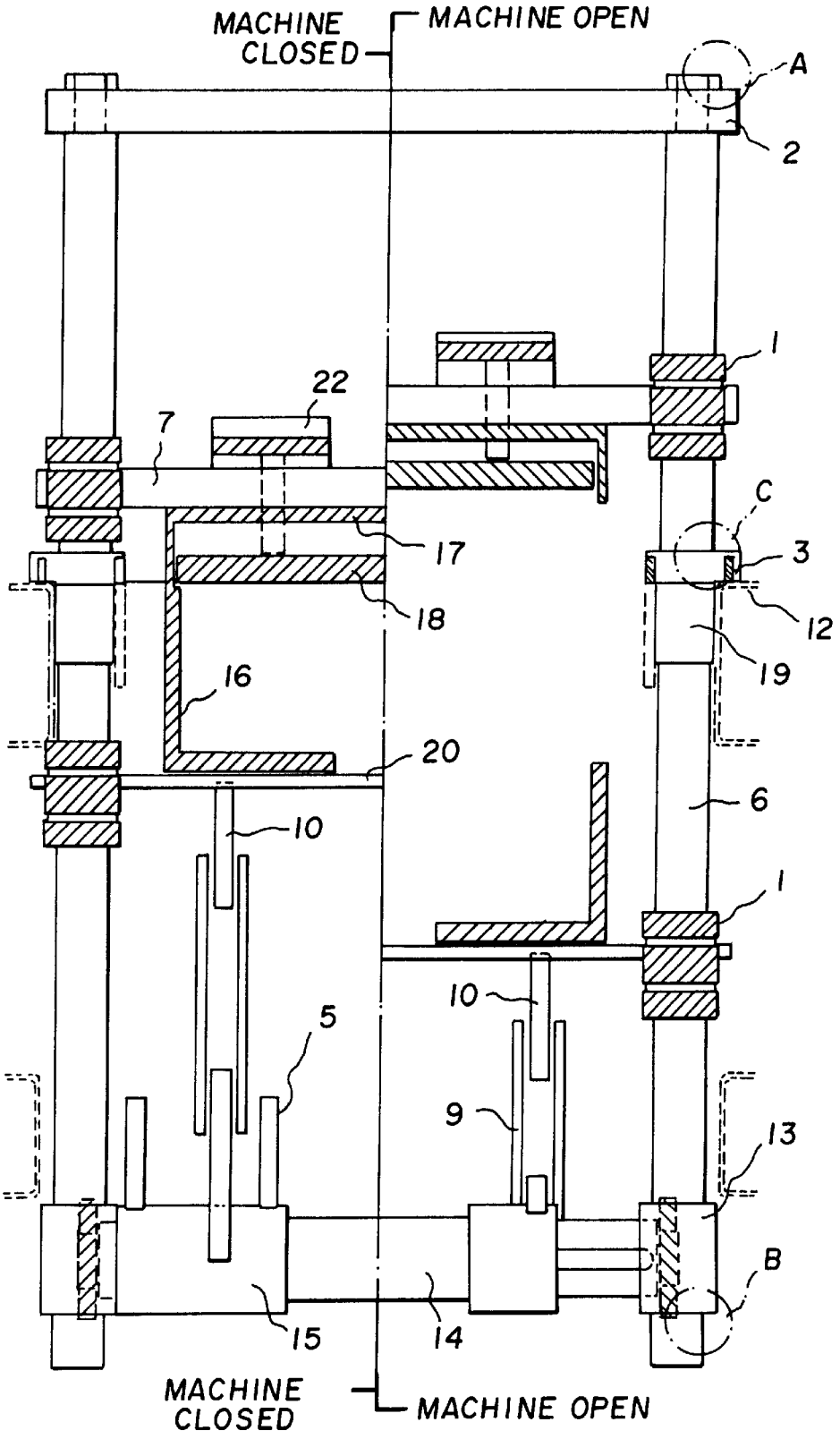

Both the seal bridge and the lifting table carry halves of the packaging chamber. The seal bridge holds the upper seal chamber [17] which houses the sealing frame [18]. The lifting table holds the lower seal chamber clamp element 8 (FIG. 1) forming lower seal chamber 16 (FIG. 2).

SEQUENCE OF OPERATION

After the packaging machine indexes a set of formed and filled pouches into the sealing station, the packaging operation begins.

Step one is the upper toggle system moves the seal bridge [7] down to the locked position, toggles [4] are in a straight line. FIG. #1

Step two the lower toggle [9] and crank shafts [15] are rotated; and, the lifting rails [10] move the lower platen or lifting table [20] to it's most upper and locked position. FIG. #1

As seen in FIG. #2. When both the seal bridge and the lifting table are in their locked position, the upper seal chamber [17] and the the lower seal chamber and seal support frame [16] are clamped together forming a vacuum tight chamber to perform the needed evacuation and/or gassing operations. The lifting assembly also insures that the seal support frame is held in place during the sealing operation. The seal cylinders [22] push the heated seal frame [18] down against the lower seal chamber and seal support frame [16].

After the packaging sequence is finished, the lifting table is lowered by rotating the crank shafts, unclamping the lower and upper seal chambers. Then the seal bridge [7] is raised, moving the heated seal frame [18] away from the package and the product. The greatest benefit of the moving seal bridge is during a prolonged pause in the operation of the packaging machine, the heated seal frame is moved away from the product preventing burning or other damages. The novel placket machine has two guide shafts [6] which function as an alignment shaft for both the upper platen or seal bridge [7] which is slideably attached or journalled at [1] to the guide shafts or alignment shafts [6] as well as for a lower platen or lifting table [20] which is slideably attached or journalled at [1] to the alignment or guide shafts [6].

What is claimed is:

1. A platen machine comprising:

(a) a support frame;

(b) a first and a second alignment shaft;

(c) a first platen journalled to said first and said second alignment shaft;

(d) a second platen journalled to said first and said second alignment shaft; and (e) a carrier assembly disposed on said first and said second alignment shaft intermediate said first platen and said second platen said carrier assembly having a plurality of wheels for engaging said support frame.

2. The platen machine of claim 1 wherein said second platen includes an arrangement of links for moving said second platen.

3. The platen machine of claim 2 wherein said arrangement of links for moving said second platen is pneumatically activated.

4. The platen machine of claim 2 wherein said first platen includes an arrangement of links for moving said first platen.

5. The platen machine of claim 4 wherein said arrangement of links for moving said second platen and said arrangement of links for moving said first platen are pneumatically activated.

6. The platen machine of claim 5 further comprising an independently controlled heat sealing element attached to said first platen.

7. The platen machine of claim 6 wherein said heat sealing element is pneumatically activated.

8. The platen machine of claim 7 wherein said heat sealing element is independently advanced and retracted from said first platen.

9. The platen machine of claim 8 further comprising means for modifying the atmosphere in packages before advancing said heat sealing element.

10. The platen machine of claim 5 wherein said arrangement of links for moving said second platen and said arrangements of links for moving said first platen are supported by said first and said second alignment shaft.

11. A product packaging machine comprising:

(a) a pair of vertical alignment shafts for bearing clamping forces;

(b) an upper platen journalled to said pair of vertical alignment shafts;

(c) a lower platen journalled to said pair of vertical alignment shafts;

(d) a carrier assembly disposed on said pair of vertical alignment shafts intermediate said upper platen and said lower platen; and (e) a frame connected to said carrier assembly for bearing the weight of the product packaging machine.

12. The product packaging machine of claim 11 further comprising a plurality of wheels disposed on said carrier assembly for engaging said support frame.

13. The product packaging machine of claim 11 further comprising an independently activated heat sealing means disposed on said upper platen.

14. The product packaging machine of claim 13 wherein said upper platen, said lower platen and said heat sealing means are activated pneumatically.

15. The product packaging machine of claim 14 wherein said upper platen includes an upper seal chamber and said lower platen includes a lower seal chamber and said heat sealing means travels from said upper seal chamber to said lower seal chamber.

16. The product packaging machine of claim 15 wherein said upper platen is pneumatically activated to advance toward said lower platen and said lower platen is pneumatically activated to advance toward said upper platen and close said upper seal chamber and said lower seal chamber on a packaged article and said heat sealing means is pneumatically activated to heat seal said package.

17. The product packaging machine of claim 11 further comprising a combination of links and actuator means for actuating said lower platen attached to said pair of vertical alignment shafts.

18. The product packaging machine of claim 17 further comprising a combination of links and actuator means for actuating said upper platen attached to said pair of vertical alignment shafts.

19. The product packaging machine of claim 11 further comprising a combination of links and actuator means for actuating said lower platen attached to said pair of vertical alignment shafts.

20. A machine for filling and packaging comprising:

(a) a pair of vertical alignment shafts for accommodating clamping forces;

(b) an upper platen slidably disposed on said pair of vertical alignment shafts;

(c) a lower platen slidably disposed on said pair of vertical alignment shafts;

(d) a carrier assembly disposed on said pair of vertical alignment shafts intermediate said upper platen and said lower platen;

(e) a support frame connected to said carrier assembly for bearing the weight of the machine; and (f) a heat sealing plate disposed intermediate said upper platen and said lower platen, said heat sealing plate independently moveable with respect to said upper platen and said lower platen.

21. The machine for filling and packaging of claim 20 wherein said carrier assembly includes a plurality of wheels for engaging said support frame.

22. The machine for filling and packaging of claim 20 wherein said upper platen, said lower platen and said heat sealing plate are pneumatically controlled.

23. The machine for filling and packaging of claim 22 wherein said upper platen includes an upper half of a clamp and said lower platen includes a lower half of a clamp and wherein said lower half of said clamp is wider than said upper half of said clamp to form a sealing lip when said upper half of said clamp and said lower half of said clamp are closed.

24. The machine for filling and packaging of claim 23 wherein a heat sealing plate is disposed on said upper platen and travels between said sealing lip and said upper half of said clamp.

* * * * *